United States Patent [19]

Okajo

[11] Patent Number: 4,725,868

[45] Date of Patent: Feb. 16, 1988

[54] ELECTROSTATIC COPYING MACHINE

[75] Inventor: Yukio Okajo, Osaka, Japan

[73] Assignee: Mita Industrial Co., Ltd., Osaka, Japan

[21] Appl. No.: 869,747

[22] Filed: Jun. 2, 1986

[30] Foreign Application Priority Data

Jun. 17, 1985 [JP] Japan ..... 60-91370[U]

[51] Int. Cl.[4] ..... G03G 15/04; G03G 21/00

[52] U.S. Cl. ..... 355/14 E; 355/69

[58] Field of Search ..... 355/3 R, 14 R, 14 E, 355/14 D, 75, 69

[56] References Cited

U.S. PATENT DOCUMENTS

| | | | |
|---|---|---|---|
| 4,200,391 | 4/1980 | Sakamoto et al. | 355/14 E |
| 4,215,930 | 8/1980 | Miyakawa et al. | 355/14 E X |
| 4,306,804 | 12/1981 | Sakamoto et al. | 355/14 E |
| 4,378,156 | 3/1983 | Yajima et al. | 355/14 E X |

*Primary Examiner*—Fred L. Braun

*Attorney, Agent, or Firm*—Jordan and Hamburg

[57] ABSTRACT

An electrostatic copying machine having an optical system for exposing to light an original placed on a contact glass plate, a sensor for detecting the density of the original and a control system for controlling image density in accordance with a detection signal from the sensor, the glass plate being provided with a light blocking white portion at a reference position thereon where the front end of the original is placed. A light blocking colored area reflecting a smaller quantity of light than the white portion is provided in the white portion at least at the part thereof corresponding to the position of detection by the sensor. Although the white portion provided for preventing the front end of copy paper from fitting around a fixing roller would result in a reduced amount of exposure for the front end portion of the original to produce an increased image density at the paper end portion and all over the paper in the case of the prescanning system, the presence of the colored area assures proper automatic density control free of such objection.

20 Claims, 5 Drawing Figures

ELECTROSTATIC COPYING MACHINE

FIELD OF THE INVENTION AND RELATED ART STATEMENT

The present invention relates to improvements in electrostatic copying machines having the function of automatically controlling the image density in accordance with the density of originals.

Examined Japanese Patent Publication No. SHO 54-36502, for example, discloses a contact glass plate provided with a light blocking white portion at a reference position thereon to form a nonimage area having a width of about 0.5 to about 20 mm at the front end of copy paper and thereby prevent the front end of the copy paper from fitting around a heat fixing roller when the copy paper is brought into pressing contact with the roller for fixing so that the copy paper can be separated off free of trouble by a separating pawl.

Electrostatic copying machines are known which have the function of automatically controlling the image density by detecting the density of an original from the light reflected therefrom and varying the quantity of light to be emitted by the optical system or the bias voltage of the developing unit. When the above-mentioned light blocking white portion is provided in such a machine, there arises the problem that the front end of copy paper becomes black for the following reason. When the light blocking white portion is exposed to light, an increased quantity of light is reflected therefrom, causing the automatic density control system to greatly decrease the amount of exposure during a period A-B corresponding to the light blocking portion as shown in FIG. 5. Although the original is present subsequent to the light blocking portion after the optical system has passed this portion at time B, a delay involved in the operation of the control system results in an increased image density and produces a dark image over an area corresponding to a period B-C required for the amount of exposure to return to a value corresponding to the density of the original. The drawback may be obviated by setting a timer so as to hold the control system out of operation during the exposure of the light blocking white portion, but this renders the control system complex in construction. Furthermore, copying machines equipped with a variable magnification device have the problem that it is difficult to assure accurate control since the scanning speed of the optical system changes.

With systems wherein the density of the original is measured by prescanning to obtain an average density and determine the amount of exposure based on the average value, the presence of the light blocking white portion produces a lower average exposure value, entailing the problem that the overall image to be formed on copy paper becomes dark.

OBJECT AND SUMMARY OF THE INVENTION

The object of the present invention which has been accomplished to overcome the foregoing problems is to provide an electrostatic copying machine which has an automatic density control function and which is adapted to properly preclude the likelihood that the image density at the front end of copy paper will increase to a level higher than is needed and to obviate a reduction in the overall density of copy images, using a simple arrangement.

The present invention provides an electrostatic copying machine having an optical system for exposing to light an original placed on a contact glass plate, sensor means for detecting the density of the original and control means for controlling image density in accordance with a detection signal from the sensor means, the glass plate being provided with a light blocking white portion at a reference position thereon where the front end of the original is placed. A light blocking colored area reflecting a smaller quantity of light than the light blocking white portion is provided in the white portion at least at the part thereof corresponding to the position of detection by the sensor means.

With the copying machine described above, the quantity of light emitted by the optical system and reflected by the less reflective light blocking colored area is detected by the sensor means, and the image density is controlled based on the detected value. Consequently, despite the provision of the light blocking white portion, the presence of the colored area precludes the likelihood that an image to be formed at the front end portion of copy paper and an overall image in the case of the prescanning system become dark.

DESCRIPTION OF THE PREFERRED EMBODIMENTS

Figure 1:
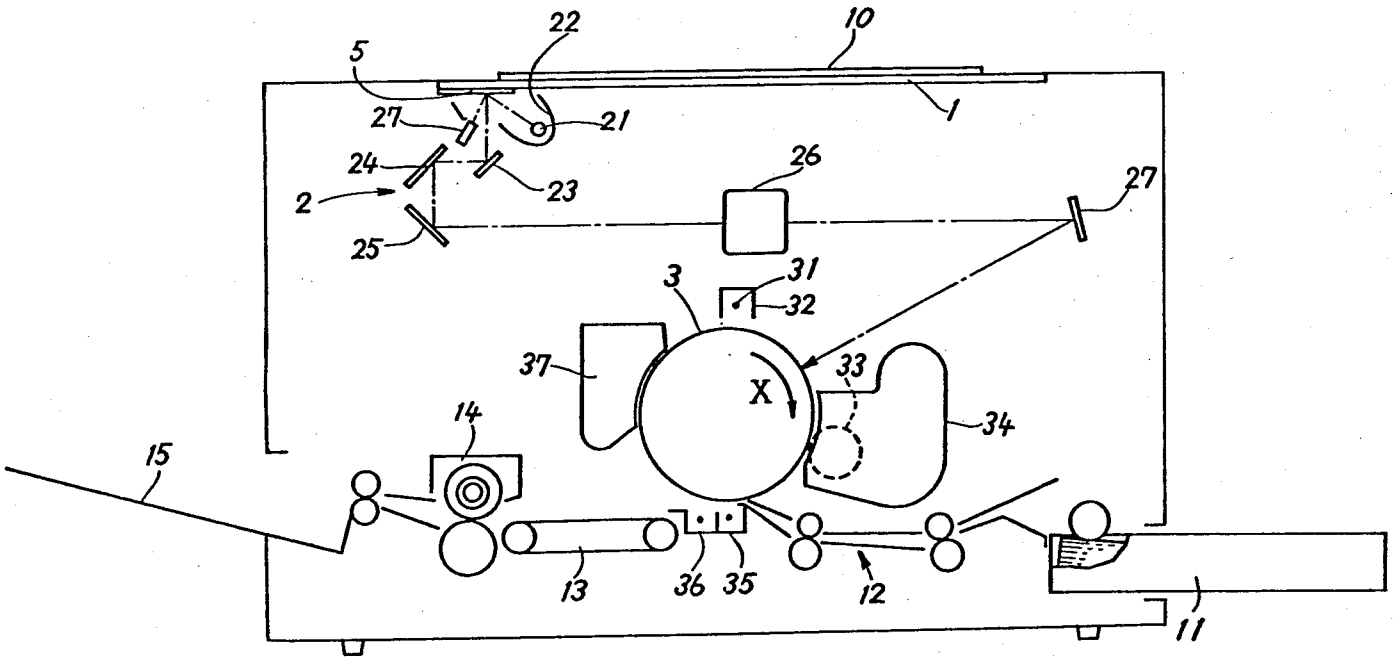
FIG. 1 is a diagram showing an embodiment of electrostatic copying machine according to the present invention.

FIG. 1 schematically shows the interior construction of an electrostatic copying machine. The drawing shows a contact glass plate 1 on the top of the machine frame. Provided within the machine frame are an optical system 2, a photosensitive drum 3 and devices arranged around the drum 3. The optical system 2 comprises an exposure lamp 21, a reflector 22, first to third mirrors 23 to 25, a condenser lens 26 and a fourth mirror 27. The exposure lamp 21, etc. reciprocatingly travel along the lower surface of the glass plate 1. An original 10 placed on the glass plate 1 is exposed to light during the forward travel of the movable members.

The drum 3 is drivingly rotatable in the direction of arrow X by unillustrated drive means. Arranged around the drum 3 are a main charger 32 having a charge wire 31, a developing unit 34 having a developing roller 33, a transfer charger 35, a separating charger 36 and a cleaner 37. With the rotation of the photosensitive drum 3, the surface of the drum 3 is sensitized by the charge wire 31 of the main charger 32 to which a high voltage is applied. The image of the original is then projected on the drum 3 by the optical system 2 to form an electrostatic latent image, which is developed by the unit 34. The developed image is transferred by the transfer charger 35 to copy paper dispensed from a paper cassette 11 and fed by a transport assembly 12. The copy paper is then separated from the drum 3 by the charger 36, thereafter sent to a fixing unit 14 by a discharge belt 13 and delivered onto a copy tray 15.

Figure 2:
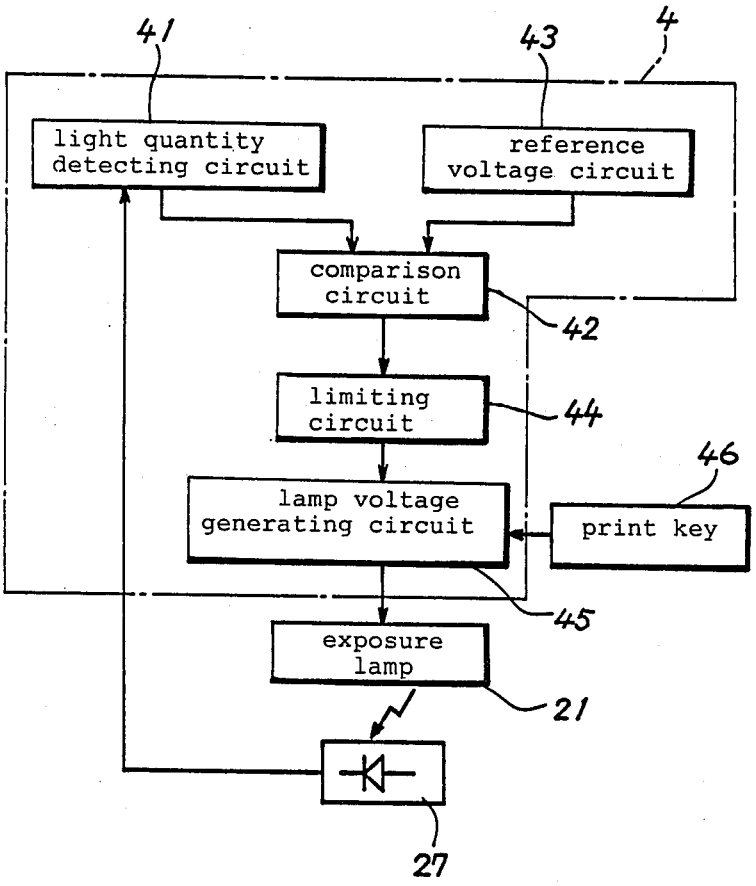
FIG. 2 is a block diagram showing an embodiment of control means.

The optical system 2 is provided with sensor means 27 comprising a photodiode or the like for detecting the density of the original 10 from a portion of the light emitted by the exposure lamp 21 against the glass plate 1 and reflected from the original 10. Stated more specifically with reference to FIG. 2, light is emitted by the exposure lamp 21 in response to an instruction from a print key 46, and the reflected light is detected by the sensor means 27. The detection signal is fed to a light quantity detecting circuit 41 of control means 4 and converted to a voltage signal. The voltage signal is delivered from the circuit 41 to a comparison circuit 42, in which the signal is compared with a reference voltage from a reference voltage circuit 43. For example, when a small quantity of light is reflected from the original because the background density thereof is high, the voltage signal from the light quantity detecting circuit 41 will be lower than the reference voltage. In this case, an instruction signal for causing the exposure lamp 21 to produce an increased quantity of light is fed to a lamp voltage generating circuit 45 via a limiting circuit 44. The circuit 45 applies a voltage in accordance with the instruction signal to the exposure lamp 21 to scan the original with a controlled quantity of light. The limiting circuit 44 is provided to prevent application of a voltage higher than a limit to the exposure lamp 21 and thereby prevent burnout of the lamp, for example, when the original has a very high density.

Figure 3:
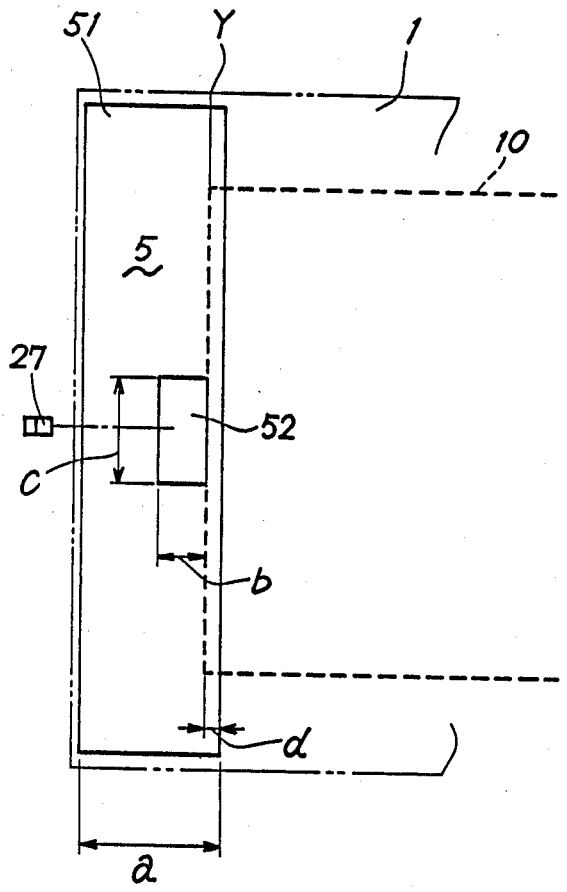
FIG. 3 is a bottom view showing an embodiment of light blocking portion.

As shown in FIG. 3, a light blocking portion 5 is provided on the lower surface of the contact glass plate 1 at a reference position where the front end of the original 10 is placed, i.e., in the vicinity of the start position of the optical system 2. The light blocking portion 5 comprises a light blocking white area 51 formed, for example, by adhering a white tape with a width a to the glass plate 1 almost over the entire width thereof, and a light blocking gray area 52 formed on the surface of the white area 51 approximately at the widthwise midportion of the glass plate 1 where the original density sensor means 27 is disposed. The gray area 52 is provided by a tape or the like having a width b and a length c and is disposed outward of the reference position Y where the front end of the original is to be located. The light blocking gray area 52 has a lightness corresponding to the average density of originals (about N3 to 7 according to the lightness scale of JIS Z8721). The color of the gray area 52 is not always limited to gray insofar as the area 52 reflects a smaller quantity of light than the white area 51. For example, any color is usable which has a wavelength outside the region of sensitivity wavelengths of the sensor of the original density sensor means 27. The following description is given with reference to the area 52 which is gray.

The operation of the electrostatic copying machine having the above construction will be described below. An original 10 is placed on the upper surface of the glass plate 1 with its front end at the reference position Y. Consequently, the surface of the front end portion of the original 10 is covered with the rear end of the light blocking white area 51 over a length d in the scan direction. When the covered portion is exposed to light by the optical system 2, a nonimage area corresponding to the length d is formed at the front end of copy paper.

Figure 4:
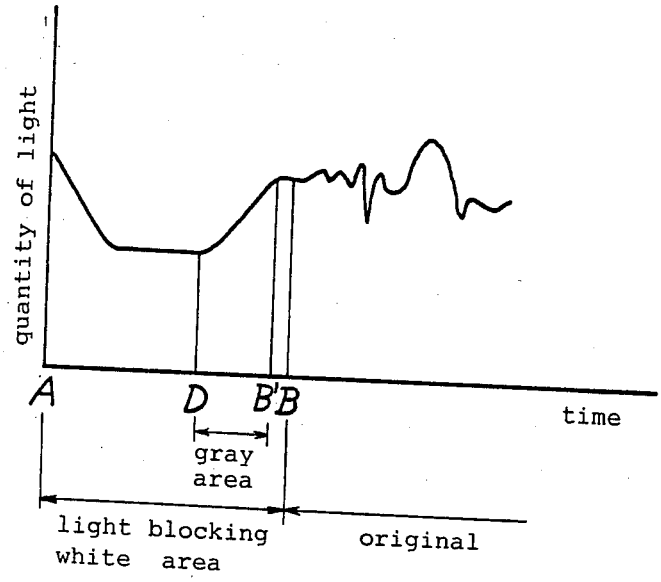
FIG. 4 is a diagram showing the exposure characteristics afforded by the present invention.
Figure 5:
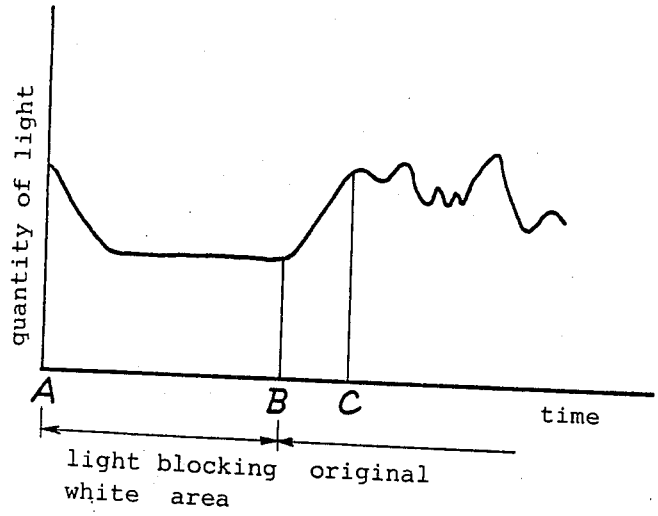
FIG. 5 is a diagram showing the exposure characteristics of a conventional system.

With the start of exposure of the original 10 by starting the optical system 2, the quantity of light reflected from the original 10 is detected by the sensor means 27, and the quantity of light of the exposure lamp 21 is controlled by the control means 4 according to the detected value along with development and transfer operation. With the start of the exposure operation, the light reflected from the light blocking white area 51 impinges on the sensor means 27, with the result that the comparison circuit 42 recognizes an excessive quantity of light. Accordingly, during a period A-D corresponding to the white area 51 shown in FIG. 4, the quantity of light emanating from the exposure lamp 21 is so controlled that the quantity gradually decreases and then levels off. Subsequently, with the start of exposure of the light blocking gray area 52, the quantity of reflected light incident on the sensor means 27 markedly decreases, so that the control means 4 gives an instruction to increase the voltage to be applied to the exposure lamp 21. Consequently, during a period D-B′ corresponding to the gray area 52, the quantity of light from the exposure lamp 21 gradually increases. The exposure of the original 10 is started at time B when an approximately standard quantity of light is reached, almost free of the influence of a period B′-B corresponding to the portion of the white area 51 having a very small width d as will be described below.

When the exposure operation is conducted with automatic control of the image density by the control means 4, the presence of the gray area 52 in the midportion of the light blocking white area 51 obviates the objectionable result that the amount of exposure for the front end portion of the original decreases under the influence of the white area 51 to darken the image at the front end of copy paper and the overall image in the case of the prescanning system. Further the white area 51 overlapping the foremost end of the original 10 over the length d forms a nonimage area on the copy paper for preventing the paper from fitting around the fixing roller. Although the quantity of reflected light temporarily increases at the portion of the white area 51 having the length d, the length d, which can be as small as about 5 mm for forming the nonimage area and need not be very large, will not result in a marked reduction in the amount of exposure.

Moreover, the present invention eliminates the need to use a complex arrangement such as one including a timer for interrupting the density control operation during the exposure of the white area and further has the advantage of assuring proper control at all times for machines equipped with a variable magnification device.

According to the embodiment described above, the image density is controlled by varying the quantity of light of the exposure lamp 21, whereas the present invention is similarly applicable to apparatus wherein the image density is controllable by varying the bias voltage of the developing unit 34. The light blocking white area 51, as well as the gray area 52, may be provided by applying a coating composition to the lower or upper surface of the glass plate 1. Furthermore, the position, size, etc. of the light blocking gray area 52 can be altered variously as required, provided that the gray area 52 is located at the position of detection by the density sensor means 27.

The present invention is applicable not only to copying machines of the type described wherein the optical system is movable but also to those having a movable document carriage.

What is claimed is:

1. An electrostatic copying machine comprising a contact glass plate, an optical system for exposing to light an original placed on said contact glass plate, sensor means for detecting the density of said original, control means for controlling image density in accordance with the detection signal from said sensor means, a light blocking white portion on said glass plate at a reference position thereon where the front end of said original is placed to provide a non-image area on the front edge of the copy paper on which a copy of the original is made, a light blocking colored area reflecting a smaller quantity of light than said light blocking white portion provided on said white portion at least at the part thereof corresponding to the position of detection by said sensor means, whereby said sensor means detects a greater density at said light blocking colored area than at said light blocking white area to thereby provide a greater amount of exposure of light by said optical system as said sensor means commences detecting the density of said original.

2. A copying machine as defined in claim 1 wherein said light blocking colored area is a gray area having a lightness corresponding to the average density of said originals.

3. A copying machine as defined in claim 1 wherein said light blocking colored area has a color with a wave-length outside the region of wavelength sensitivity of said sensor means.

4. A copying machine as defined in claim 1 wherein said light blocking colored area is disposed outward of said front end of the original.

5. A copying machine as defined in claim 1 wherein said sensor means for detecting the density of the original is operable to detect the quantity of reflected light resulting from the exposure of the original to said optical system.

6. A copying machine as defined in claim 1 wherein said optical system comprises an exposure lamp, said control means controlling the quantity of light of said exposure lamp to thereby control image density.

7. A copying machine as defined in claim 6 wherein said control means comprises a light quantity detecting circuit for receiving the detection signal from said sensor means and converting said detection signal to a voltage signal, a reference voltage circuit, a comparison circuit for comparing said voltage signal from said detecting circuit with a reference voltage from said reference voltage circuit, a limiting circuit for preventing application of a voltage above a limit to said exposure lamp, a lamp voltage generating circuit for receiving the output from said comparison circuit and determining the quantity of light of said exposure lamp.

8. A copying machine as defined in claim 1 wherein said control means controls the bias voltage of a developing unit to control image density.

9. In an electrostatic copying machine comprising a contact plate, an optical system for exposing to light an original placed on said contact plate, sensor means for detecting the density of said original, control means for controlling image density in accordance with the detection signal from said sensor means, a first light blocking means disposed on said contact plate, said first light blocking means having a first portion and a second portion delineated by a reference line, said first portion being disposed to underlie a front edge portion of an original placed on said contact plate to thereby provide a corresponding non-image area at the edge portion of the copy paper on which a copy of said original is made, a second light blocking means reflecting a smaller amount of light than said first light blocking means, said second light blocking means being disposed on at least a part of said second portion of said first light blocking means at a position which is detected by said sensor means, whereby said sensor means detects the light reflected by said second light blocking means to increase the quantity of light exposed by said optical system such that the subsequent exposure of the original is started at approximately the desired quantity of light substantially free of influence by said first portion of said first light blocking means which underlies said edge portion of the original placed on said contact plate.

10. In an electrostatic copying machine according to claim 9 whereby said non-image area at the front end of said copy paper prevents said front end of said copy paper from adhering to a heat fixing roller when the copy paper is brought into pressing contact with said heat fixing roller to thereby facilitate separation of said copy paper from said heat fixing roller.

11. In an electrostatic copying machine according to claim 9 wherein the front edge of an original to be copied is positioned at said reference line, said second light blocking means having one edge coincident with said reference line.

12. In an electrostatic copying machine according to claim 9 wherein said second portion of said first light blocking means has a width dimension greater than the corresponding width dimension of said first portion of said first light blocking means, said width dimensions being in a direction perpendicular to said reference line.

13. In an electrostatic copying machine according to claim 9 wherein said non-image area has a width of about 0.5 to about 20 mm.

14. In an electrostatic copying machine according to claim 9 wherein said contact plate has longitudinal side edges, said first light blocking means extending transversely across the width of said contact plate to said longitudinal side edges of said contact plate.

15. In an electrostatic copying machine according to claim 14 wherein said second light blocking means is disposed at a central portion of said first light blocking means spaced inwardly from said side edges of said contact plate.

16. In an electrostatic copying machine according to claim 9 wherein said first light blocking means comprises a light blocking white area on said contact plate.

17. In an electrostatic copying machine according to claim 9 wherein said second light blocking means comprises a light blocking gray area on said first light blocking means.

18. In an electrostatic copying machine according to claim 9 wherein said sensor means is operable to sequentially scan said first and second light blocking means and said original such that said sensor means initially scans the light reflected from said first portion of said first light blocking means, scans the light reflected by said second light blocking means, scans the light reflected by said second portion of said first light blocking means, and then scans the light reflected from said original, whereby said optical system increases the quantity of light exposed by said optical system during scanning of said second light blocking means to approximately the desired quantity of light corresponding to the average density of the original to be copied.

19. In an electrostatic copying machine according to claim 18 wherein said optical system provides a first quantity of light exposed by said optical system at the completion of scanning of said second portion of said first light blocking means, said optical system gradually increasing the quantity of light exposed by said optical system during scanning of said second light blocking means from said first quantity to a higher quantity corresponding to said desired quantity.

20. In an electrostatic copying machine comprising a contract plate, an optical system for exposing to light an original placed on said contract plate, sensor means for detecting the density of said original, control means for controlling image density in accordance with the detection signal from said sensor means, a first light blocking means disposed on said contact plate, said first light blocking means having a first portion and a second portion delineated by a reference line, said first portion being disposed to underlie a front edge portion of an original placed on said contact plate to thereby provide a corresponding non-image area at the edge portion of the copy paper on which a copy of said original is made, said non-image area at said edge portion of said copy paper preventing said copy paper from adhering to a heat fixing roller when said copy paper is brought into pressing contact with said heat fixing roller to thereby facilitate separation of said copy paper from said heat fixing roller, a second light blocking means reflecting a smaller amount of light than said first light blocking means and having a lightness corresponding to the average density of the originals to be copied, said second light blocking means being disposed on at least a part of said second portion of said first light blocking means at a position which is detected by said sensor means, whereby said sensor means detects a greater density of said second light blocking means than that of said second portion of said first light blocking means such that the subsequent exposure of the original is started at approximately the desired quantity of light exposure by said optical system.

* * * * *